United States Patent [19]

Kipphan et al.

[11] Patent Number: 4,856,903

[45] Date of Patent: Aug. 15, 1989

[54] ELECTRONIC DEVICE FOR DETERMINING A REGISTER ERROR IN MULTI-COLOR PRINTING MACHINES

[75] Inventors: Helmut Kipphan, Schwetzingen; Willi Jeschke, Heidelberg, both of Fed. Rep. of Germany; Hans Ott, Regensdorf; Jean-Pierre Graf, Massagno, both of Switzerland

[73] Assignee: Heidelberger Druckmaschinen AG, Heidelberg, Fed. Rep. of Germany

[21] Appl. No.: 40,570

[22] Filed: Apr. 17, 1987

[30] Foreign Application Priority Data

Apr. 18, 1986 [CH] Switzerland ..... 01567/86
Jun. 13, 1986 [CH] Switzerland ..... 02392/86

[51] Int. Cl.[4] ..... B41F 13/24
[52] U.S. Cl. ..... 356/400
[58] Field of Search ..... 356/399, 400, 444, 73

[56] References Cited

U.S. PATENT DOCUMENTS 4,545,684 10/1985 Kuroki et al. ..... 356/400
4,596,468 6/1986 Simeth ..... 356/73

FOREIGN PATENT DOCUMENTS 0177885 4/1986 European Pat. Off. .
2051065 4/1972 Fed. Rep. of Germany .
3536263 3/1976 Fed. Rep. of Germany .
2848963 8/1979 Fed. Rep. of Germany .
3512002 12/1985 Fed. Rep. of Germany .

*Primary Examiner*—Richard A. Rosenberger
*Attorney, Agent, or Firm*—Herbert L. Lerner; Laurence A. Greenberg

[57] ABSTRACT

Device for determining a register error between individual colors in multicolor printing machine, comprising a photoelectric scanning apparatus for scanning differently colored register marks printed together on a printed sheet, an evaluation apparatus interacting with the scanning apparatus for determining the relative positions of the individual register marks, the scanning apparatus being disposed in a housing to be positioned at a given measuring location on the stationary printed sheet, the scanning apparatus comprising a scanning head movably disposed in the housing, and drive a device provided in the housing for producing the scanning movement of the scanning head relative to the printed sheet within a relatively small scanning region.

14 Claims, 9 Drawing Sheets

ELECTRONIC DEVICE FOR DETERMINING A REGISTER ERROR IN MULTI-COLOR PRINTING MACHINES

The invention relates to an electronic register error-determining device for correcting register color marks intended for use with color-printing machines.

In multicolor printing, there must be highly precise correspondence between the partial images printed with the individual printing inks. To check the relative positional differences of the individual partial images, the so-called register error use is made usually of register marks which are printed together and are evaluated visually or, presently, also photoelectrically and possibly also with the aid of a computer. Examples of such more or less automated photoelectric register-measuring systems are described in German Published Prosecuted Application (DE-C) No. 32 48 795 (corresponding to U.S. Ser. No. 335,764 filed Dec. 30 1981), U.S. Pat. No. 4,534,288 and German Published Prosecuted Application (DE-C) No. 3,226,078 (corresponding to Japanese Application No. P114273-81 of 21.7.81). These systems all operate on-line on a running printing press with special register marks and appropriately adapted, conventional scanning apparatuses. Hand-held devices of a comparable nature for off-line operation have so far been unknown. In addition, on-line and off-line systems have also become known which scan the register marks with television cameras and display them. However, such systems are relatively complex and too elaborate for many applications.

It is accordingly an object of the invention of the instant application to provide a hand-held device, specially constructed for off-line operation, for overcoming the drawbacks of the prior art devices for detecting a register error, and which offers the advantages of simplicity of construction as well as ease and reliability of use, while yet insuring, that the pertinent requirements are placed on the positioning accuracy of the measuring device.

With the foregoing and other objects in view, there is provided, in accordance with the invention, a device for determining a register error between a individual colors in a multi-color printing machine, which includes a photoelectric scanning apparatus for scanning differently colored register marks printed together on a printed sheet, an evaluation apparatus interacting with the scanning apparatus for determining the relative positions of the individual register marks, the scanning apparatus being disposed preferably together with the evaluation apparatus in a housing to be positioned at a given measuring location on a stationary printed sheet; the scanning apparatus comprising a scanning head movably disposed in the housing and drive means provided in the housing for producing a scanning movement of the scanning head related to the printed sheet within a relatively small scanning region.

In accordance with a further feature of the invention, the scanning head of the device is linearly movable in the housing.

In accordance with an added feature of the invention, the scanning head is rotatably movable in the housing.

In accordance with an additional feature of the invention, the scanning apparatus and the evaluation apparatus operate to detect at least one of line-shaped and line-containing register marks, and to determine their relative positions.

In accordance with again another feature of the invention, the scanning head has at least one aperture diaphragm having a linear slit disposed in such relationship to the housing that, when in use, the slit is oriented parallel with the line-shaped register marks to be scanned.

In accordance with again a further feature of the invention, the scanning head has two slit-shaped aperture diaphragms, the slit being disposed at an angle of either 45 degrees or 90 degrees to one another.

In accordance with again an added feature of the invention, the scanning head has means for scanning, point-by-point, a two-dimensional scannng region.

In accordance with again an additional feature of the invention, there is provided a register mark for determining register errors in multicolor printing machines, which includes at least one angle for each color to be printed, each angle being formed of two rectilinear line-shaped sides and being individually differently colored, each angle being disposed, substantially uniformly spaced, in a circle so that their tips point to the center of the circle.

In accordance with yet another feature of the invention, a substantially cruciform element is disposed in the center of the circle, each element having a color conforming with at least one of the colored angles or having a color which is a superposition of all of the printed colors.

In accordance with yet a further feature of the invention, for each printed color being printed, the register mark comprises at least one element having a first and a second rectilinear line-shaped side, the individual differently colored elements being disposed parallel, at intervals along a straight line, and the sides of each element being inclined by preferably 45 degrees to one another.

In accordance with yet an added feature of the invention, two sides of the elements are spaced separately from one another, and firstly all first sides and then all second sides of the differently colored elements are spaced in succession along the straight line.

In accordance with yet an additional feature of the invention, the scanning head contains a line array and, is swivelable into two fixed positions for measuring the register mark, one after the other, in the housing.

In accordance with still another feature of the invention, the scanning head contains at least one of a line array and an area array, and is linearly movable in one direction inside the housing.

In accordance with still a further feature of the invention, there is provided a device for determining a register error between individual colors in multicolor printing, comprising a photoelectric scanning apparatus for differently colored register marks printed together on a printed sheet, and an evaluation apparatus, interacting with the scanning apparatus, for determining the relative positions of the individual register marks, the scanning apparatus being disposed in a housing to be positioned at a given measuring location on the stationary printed sheet, and the scanning apparatus includes an area array serving as a receiving element for detecting a two-dimensional scanning region and for evaluating register marks without mechanical motion.

In accordance with still an added feature of the invention, there is provided a device for determining register error between individual colors in multicolor printing, comprising a photoelectric scanning apparatus for scanning differently colored register marks printed together on the printed sheet, and an evaluation apparatus, interacting with the scanning apparatus for determining the relative positions of the individual register marks, the scanning apparatus being disposed in a housing to be positioned at a given measuring location on the stationary printed sheet, and being equipped with two line arrays, the line arrays being disposed perpendicularly to one another for detecting line marks, and the line marks being disposed perpendicularly to one another for evaluating register marks without mechanical motion.

In accordance with still an additional feature of the invention, there is provided a device for determining a register error between individual colors in multicolor printing, comprising a photoelectric scanning apparatus for differently colored register marks printed together on a printed sheet, and an evaluation apparatus interacting with the scanning apparatus for determining the relative positions of the individual register marks, the scanning apparatus being disposed in a housing to be positioned at a given measuring location on the stationary printed sheet, and being equipped with a line array and a register mark having lines for circumferential and side register for each color being measured with one measurement without mechanical motion, the lines being neither parallel nor at right angles to one another.

In accordance with another feature of the invention, there is provided a device for determining a register error between individual colors in multicolor printing, comprising a stationary photoelectric scanning apparatus for differently colored register marks printed together on a printed sheet and having an evaluation apparatus interacting with the scanning apparatus for determining the relative positions of the individual register marks, the scanning apparatus being disposed in a housing positioned at a given measuring location on the stationary printed sheet, and a movable optical system projecting the register mark onto the stationary receiving element in the stationary scanning apparatus.

In accordance with a concomitant feature of the invention, the housing is equipped with an optical or optoelectronic apparatus for assistance during the visual aligning of the scanning apparatus on the register mark.

Other features which are considered as characteristic for the invention are set forth in the appended claims.

Although the invention is illustrated and described herein as embodied in an electronic device for determination of the register error in multi-color printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

In the following, the invention is described in greater detail with reference to the drawings, in which:

FIG. 1 is a diagrammatic elevational representation of an embodiment of the invention having circular scanning-head motion;

FIG. 2*a* and 2*b* each are diagrammatic views of register marks for five-color printing, in one case with an in the other case without register error;

Figure 1:
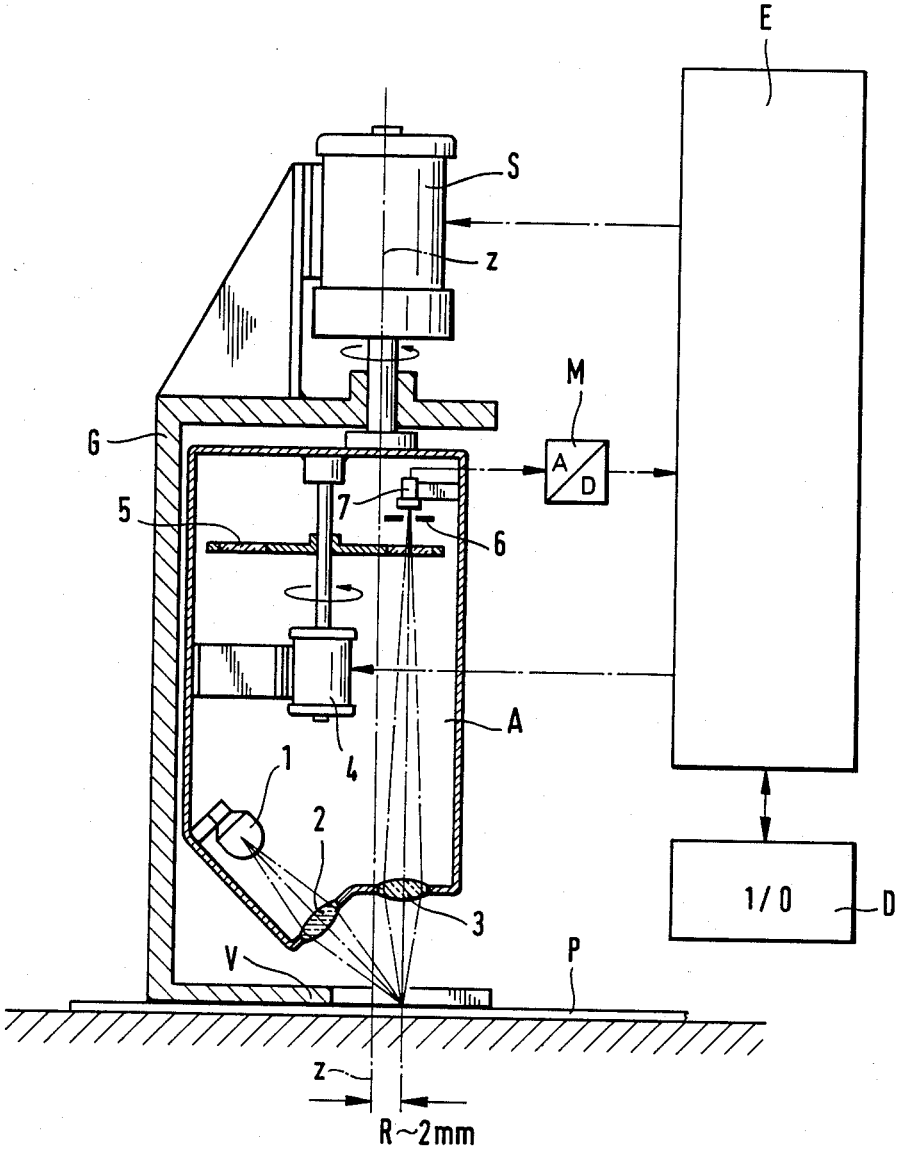

The device shown in FIG. 1 is in the form of a hand-held device, all parts being accommodated in a housing G, which is shown here only in outline. The construction of the device is largely very similar to that of hand-held densitometers. Of course, other constructions are also possible.

Accommodated in the housing G are a rotatable scanning head A, a stepping motor S for driving the scanning head, a measuring transducer circuit M, a control and computing circuit E and an input/output unit D. The I/O unit D can be formed of control keys and a display and/or interfaces to further devices. The scanning head A is rotatable about a vertical axis Z and contains a light source 1, illumination optics 2 and measuring optics 3, a filter wheel 5 driven by means of a motor 4, an aperture diaphragm 6 and a photoelectric receiver 7 which is connected to the measuring transducer M. Except for the fact that the scanning head A is rotatable and the scanning data are evaluated differently, the device is thus, as already mentioned, somewhat similar to a commercially available hand-held densitometer, with the result that further explanatory remarks on the construction thereof are superfluous.

In operation, the device is placed by hand on the printed sheet P which is to be evaluated, so that a register mark printed together comes to lie inside a sighting aperture V provided in the housing G, and the scanning operation is then triggered automatically or by pressing a button. In this connection, the lamp 1 produces on the printed sheet P a very fine, punctiform light spot LF (FIG. 3) which is imaged onto the aperture diaphragm 6 via the measuring optics 3. The photosensitive cell 7 measures the light penetrating through the aperture diaphragm 6. The light spot is approximately 2 mm outside the rotational axis Z of the scanning head A and moves, therefore, during the rotation of the scanning head, along a circular path K, and the printed sheet is scanned circularly. The filter wheel 5 serves for color-splitting the measuring light and makes it possible to allocate the scanning values to the individual printing colors.

Figure 2A:
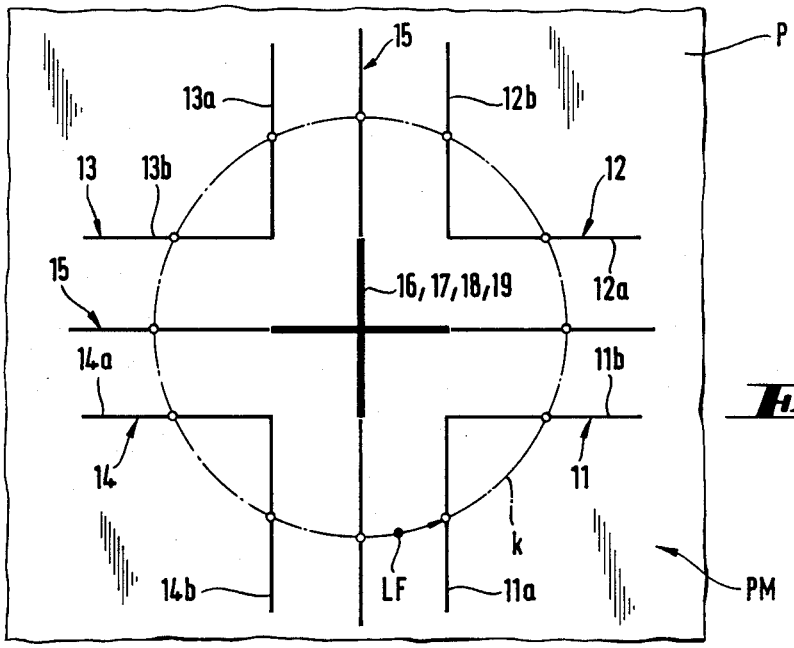
Figure 2B:
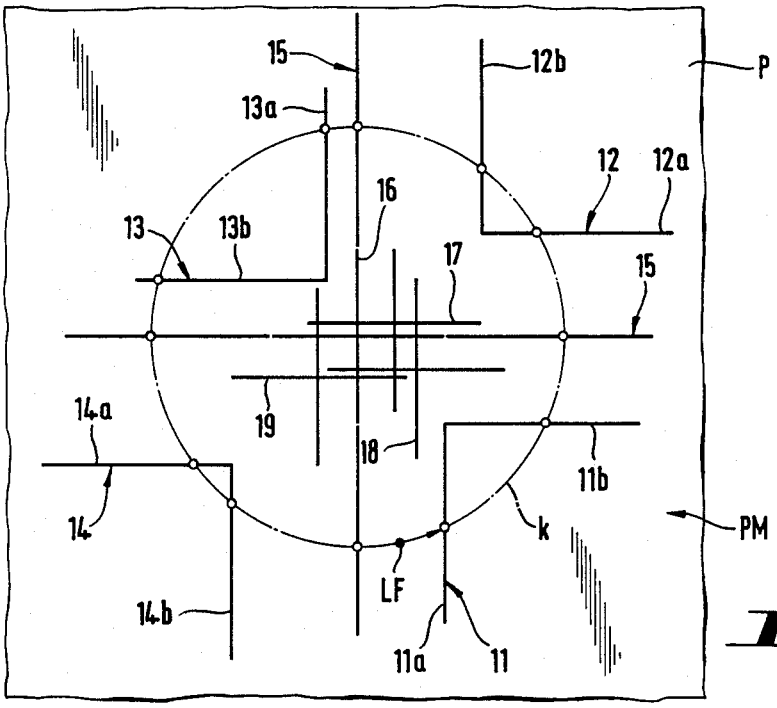

FIG. 2*a* and 2*b* show an embodiment of a register mark PM suitable for circular scanning with the previously described device, in this case, for example, for five-color printing (four colors plus black). The mark PM comprises four angles 11–14 and one cross 15. The angles are each formed of two sides 11*a*, 11*b* and 14*a*, 14*b* which are inclined at 90 degrees to one another; in the manner shown, the angles are disposed at regular intervals in a circle about the center of the cross. Each angle is of a different color and originates accordingly from a different printing operation. Although the individual parts of the register mark have defined nominal positions in relation to one another (FIG. 2*a*), they do not cover one another even in the case of an ideal print, i.e. one without register error. Therefore, this register mark is not suitable for visual inspection. In order, in addition to the mechanized determination of the register error, also to permit visual examination, the register mark may contain in its center a four additional cruciform elements 16–19 which under ideal conditions cover one another. FIG. 2*a* shows the ideal case, FIG. 2*b* showing a register mark indicating a register error.

The register mark shown here by way of example can, of course, be varied in diverse ways. In particular, by appropriate adaptation of the division of the circle and of the angles, it is possible for it to be extended or reduced to cover more or less printing colors. Also, for example, the cross 15 in the center of the mark can be replaced by four lines arranged in the shape of a cross or by a similar pattern. Furthermore, of course, it is also possible for the parts provided for visual inspection to be dispensed with.

Figure 3:
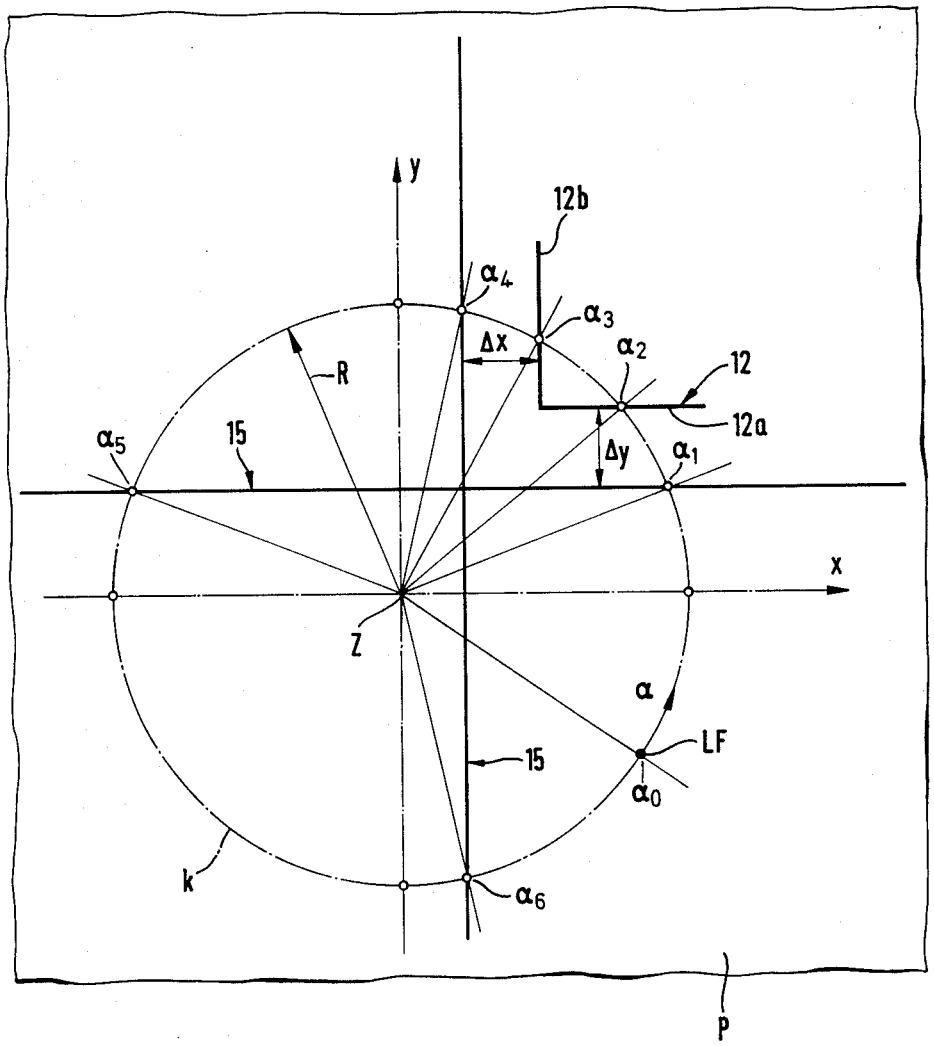
FIG. 3 is a diagram explaining the computation of the register error in the case of circular scanning.

FIG. 3 explains the determination of the register error. This is understood to mean the misalignment in the printing direction (direction of movement of the printed sheet in the printing press) and in the transverse direction of each individual partial image in relation to a freely selectable reference image (usually black).

The rotating scanning head A scans the register mark PM along a circular path K. The diameter of this circular path is, for example, approximately 4 mm. The center of the circle given by the projection of the rotatinal axis Z of the scanning head A is identified by Z. The light spot LF moves in angular increments of e.g. $<0.36$ degrees (1000 increments per revolution) in a circle. Of course, a higher resolution is also possible, for example, approximately 2000 or 3000 increments per full revolution. Since the radius of the scanning path is fixed, the position of the light spot LF is unambiguously defined by its angular position. The zero position (angle reference line), which can be permanently set at any desired position, is identified by $\alpha_o$ in FIG. 3. The printing direction and the transverse direction are indicated by the coordinate axes x and y.

For reasons of clarity, FIG. 3 shows only a part of the register mark PM shown in full in FIGS. 2*a* and 2*b*. In this case, in FIG. 3, only the black center cross 15 and a colored angle 12 are shown. When, on its scanning path, the light spot sweeps over one of the line-shaped sides of the parts of the mark, there is a noticeable change in reflection, which is evaluated in the control and computing circuit E in accordance with customary methods in order to determine the points of intersection. The thus determined angular positions of these points of intersection are identified by $\alpha_1$ to $\alpha_6$. From these angles, it is now possible to calculate the distances $\Delta x$ and $\Delta y$ between the center cross 15 (used here as a reference by way of example) and the angle 12; this is done using the equations $$x = 2R \cdot \sin\frac{\alpha_3 - \alpha_6}{2} \cdot \sin\frac{\alpha_4 - \alpha_3}{2} \quad (1)$$

$$y = 2R \cdot \sin\frac{\alpha_5 - \alpha_2}{2} \cdot \sin\frac{\alpha_2 - \alpha_1}{2} \quad (2)$$

In a similar manner it is possible to calculate the distances with respect to the other parts of the mark.

By a trivial calculation it can be shown that the determination of $\Delta x$ and $\Delta y$ is independent of the positioning of the device on the printed sheet, both with respect to the distance from the theoretical center point of the mark and also with respect to the angular position of the device in relation to the coordinate network x-y. Of course, the device must be roughly positioned at least in a manner that the register mark is not outside the circular scanning region of the device as in this embodiment.

The reflection signals supplied by the photoelectric transducer 7 are conditioned in the amplifier or A/D converter M. The calculation of the distances $\Delta x$ and $\Delta y$ and, from them, of the register error (by subtraction of the defined nominal distances) is performed in an evaluation apparatus contained in the control and computing circuit E or formed by the latter. The control and computing circuit E also provides the control of the drive motors S and 4 as well as of the light source 1 and checks and coordinates all sequences necessary for the measuring operation, as is the case also in a modern computer-controlled hand-held densitometer. The operation of the device and the indication of the measurement results are accomplished by way of the input/output unit D, once again in a similar manner to hand-held densitometers.

The line widths of the register mark shown in FIGS. 2*a* and 2*b* are preferably approximately 0.1 mm, the mark itself having an extent of, for example, approximately $7 \times 7$ mm$^2$. The distances between two neighboring parallel sides of parts of the mark belonging to different colors are approximately 0.8 mm. This provides a practical arrangement with high precision (0.01 mm).

The scanning of the colored parts of the mark may be single-or nulti-channel, sequential or parallel. In the case shown, color splitting is accomplished by color filters disposed in a filter wheel. Of course, it is also possible to use other methods. It is merely important that the lines of the individual parts of the mark can be precisely located and can be allocated to the corresponding printing colors.

Figure 4:
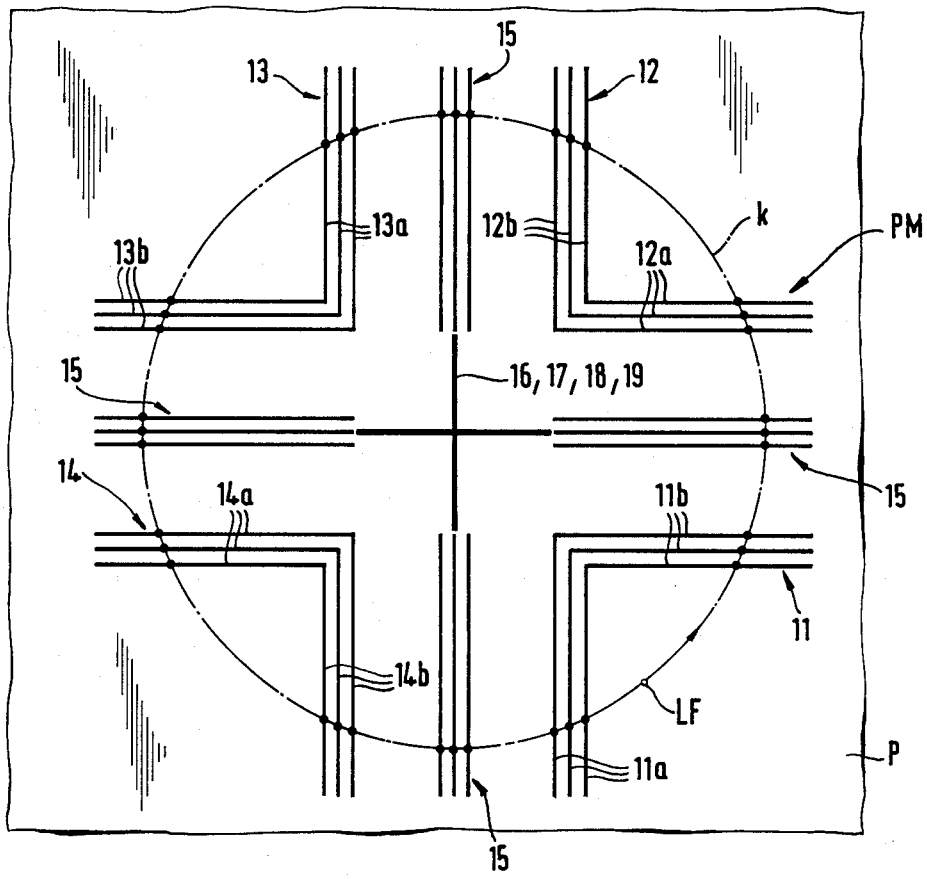
FIG. 4 is a diagram of a different embodiment of a register mark for circular scanning.

To increase the measuring reliability, the register mark may be configured as in FIG. 4. In this case, there are three each of the colored angles 11–14, which are four in number in this case as a result of which the measurement is provided with redundancy, and any errors and uncertainties can be eliminated. Once again, the arrangement of the individual colored angles is such that, even with the greatest anticipated register error, there is no printing of parallel sides one on top of the other.

Figure 5:
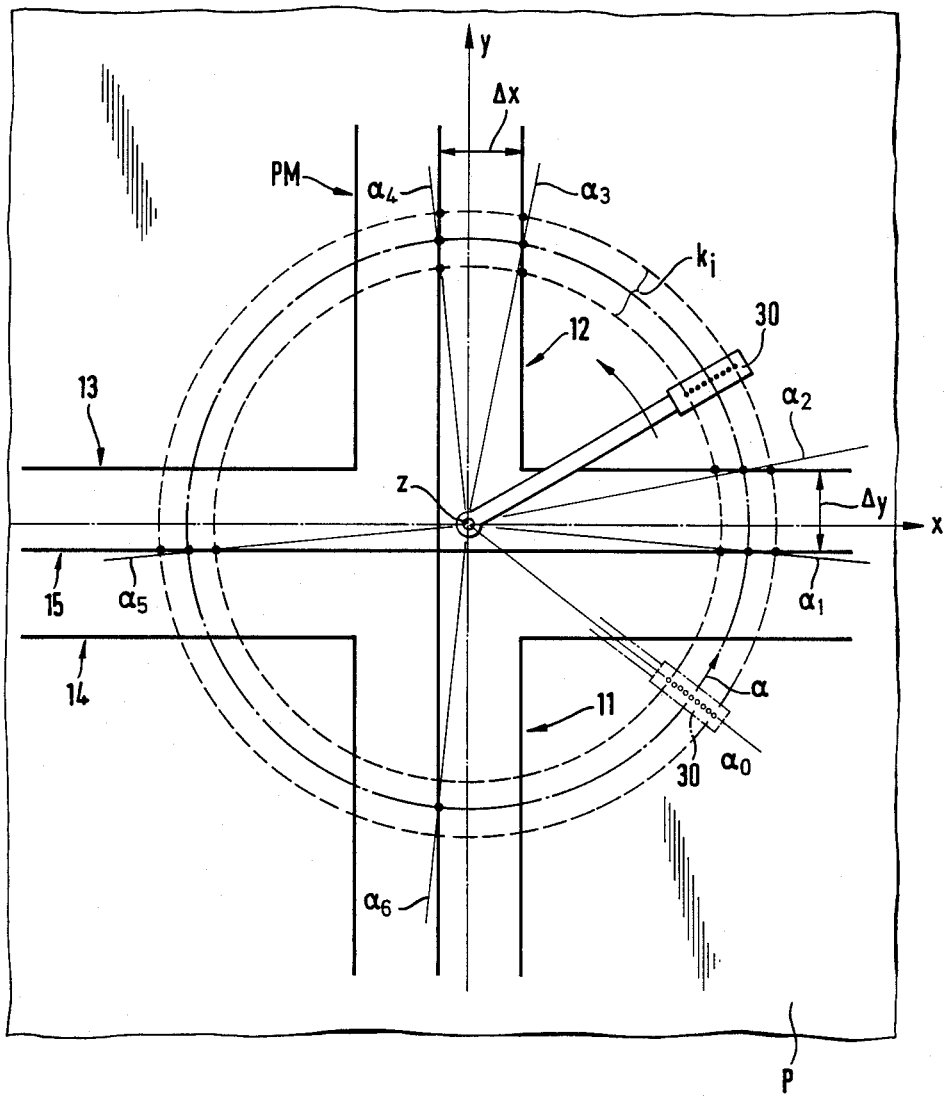
FIG. 5 is a diagrammatic plan view of a two-dimensionally operating scanning apparatus.

To further improve the measuring accuracy and reliability, the scanning of the register marks may also be two-dimensional. This is understood to mean that the scanning spot does not move along one individual linear path, but sweeps over a more-or-less large area and scans the latter point by point. As shown in FIG. 5, for example, this may be accomplished by means of a line of diodes (photodiode array) 30 formed of a multiplicity of individual light-sensitive diodes. This line of diodes rotates about an axis z and, in doing so, scans the register mark PM along a number of concentric circular tracks k corresponding to the number of photodiodes.

An alternative to this, for example, is to allow only one individual photosensitive cell to rotate and, instead, the radius of the scanning track is changed.

A further alternative provides for the use of a stationary two-dimensional photodiode array or the like covering the entire scanning region, with the point-by-point scanning being accomplished by selective interrogation of the individual photodiodes.

Given appropriate construction of the register mark, the measurement can be performed without mechanical scanning of the register mark by using two lines of photodiodes (line array) disposed, for example, at right angles to one another. Even if using a line or area array with linear, mechanical scanning of the register mark in only one direction, a comprehensive detection of the entire register mark is possible.

If, in particular, color-capable arrays or a combination of optic filters and arrays are used, then, in conjunction with suitable software means, it is possible to have the color-oriented measuring of the register marks without it being necessary to comply with a fixed color sequence of the register marks.

Figure 6:
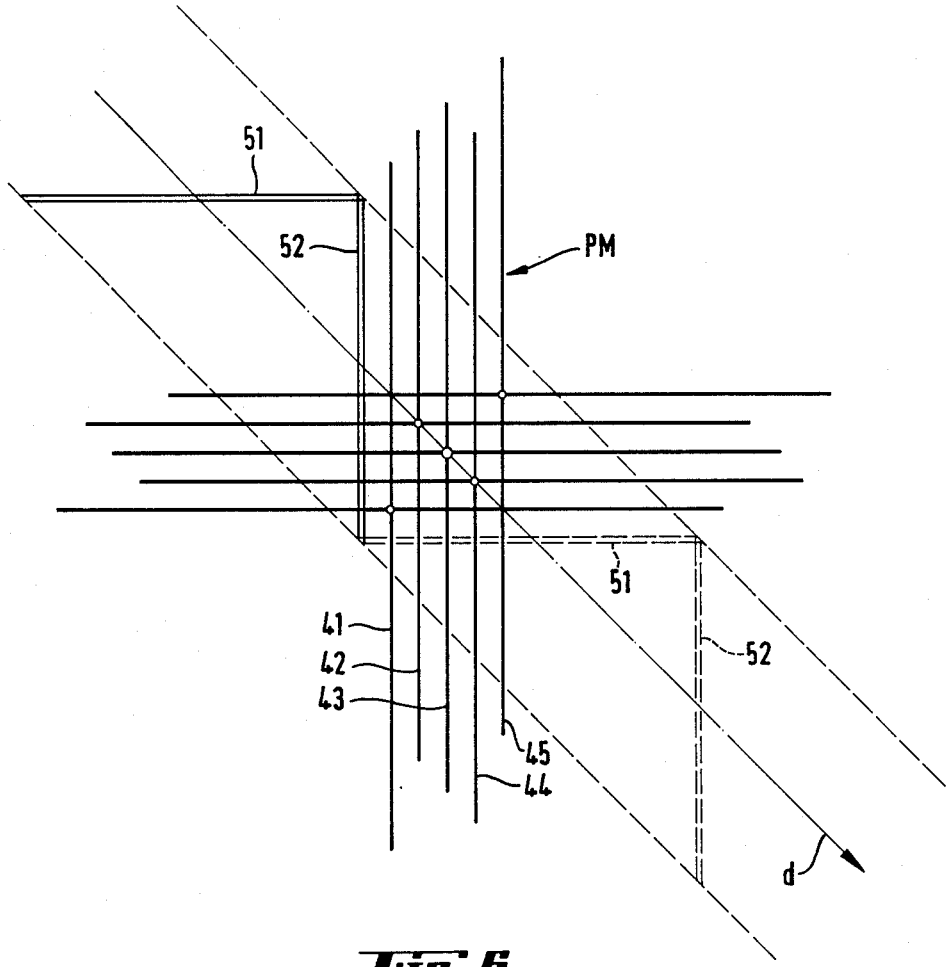
FIG. 6 is a diagrammatic view of a register mark suitable for linear scanning.

The register marks need not necessarily be scanned along a circular track. For example, given appropriate design of the register marks and adaptation of the scanning apparatus, it may also be advantageous to have linear scanning. FIG. 6 shows an example of this. In this case, the register mark PM is formed of conventional cross-type register marks 41–45. Through aperture diaphragms suitably disposed in the optical path, the scanning apparatus A produces two scanning lines 51 and 52 disposed at right angles to one another, with the entire device being so positioned above the register mark in operation that the two scanning lines are each parallel to one side of the cross-type register marks. By means of a stepping motor or other suitable drive, the scanning head and with it the scanning lines 51 and 52 are scanned in a diagonal direction d. In this connection, each scanning line detects only the bars of the cross-type register marks parallel to it. From the succession of the individual bars it is then possible in a simple manner to determine their relative positions and thus the register error.

Scanning with the two scanning lines 51 and 52 is performed separately for both lines. For this purpose, either two different scanning systems may be provided, or means are provided to produce one single scanning line which can be brought into two positions turned through 90 degrees with respect to one another. In this case, scanning would be performed, for example, in two operations one after the other.

Figure 7:
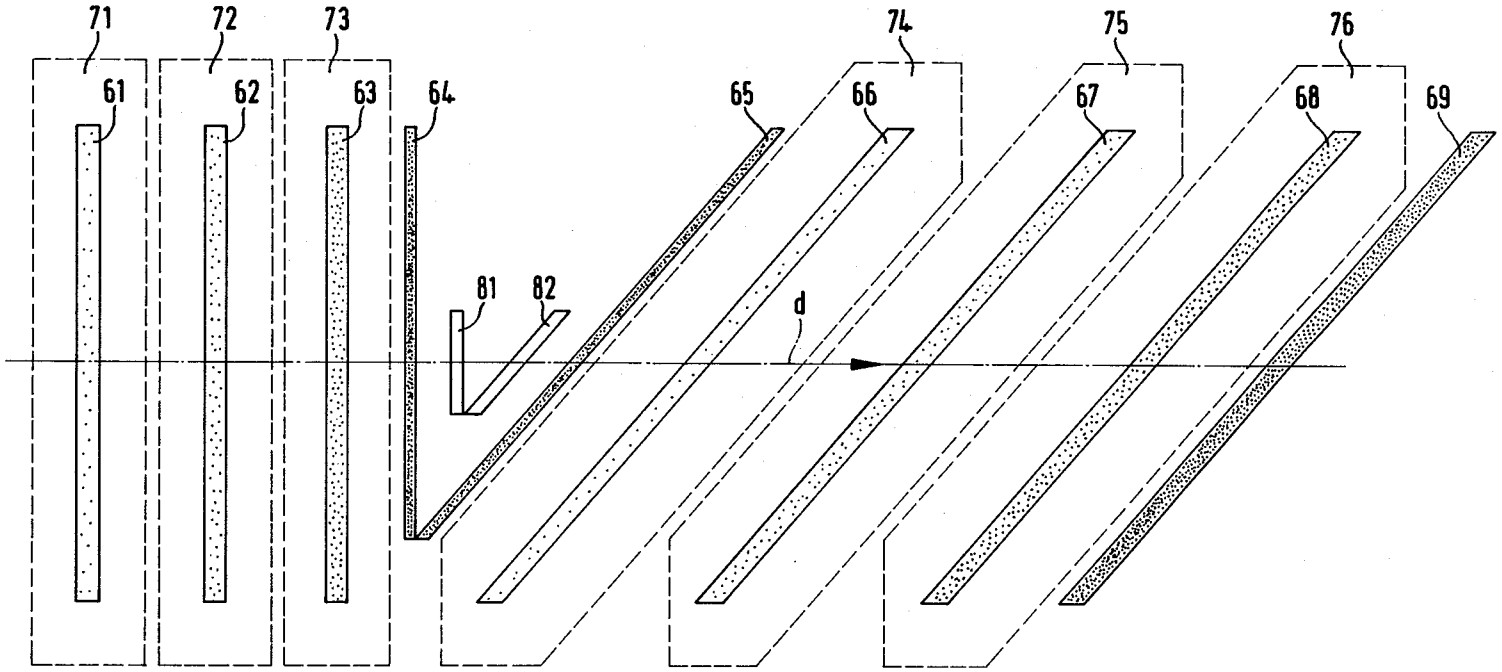
FIG. 7 is a diagrammatic view of yet another embodiment.

FIG. 7 shows an embodiment of a register mark which is particularly suitable for linear scanning. It consists of a series of first parallel lines 61–64 and a series of second parallel lines 65–69 inclined at 45 degrees with respect to the first lines. Each line in a series is printed in another of the printing colors involved. The nominal distances between the individual parallel lines are fixed so that, even with the maximum anticipated register error, the lines are not printed one on top of the other. In the drawing, some of the positional fluctuation ranges of the individual register lines are indicated by fields 71–76 outlined by broken lines.

It is practical for this register mark to be scanned along the line d via two scanning gaps 81 and 82 inclined at 45 degrees with respect to one another, similarly to the version shown in FIG. 6. Once again, in this connection, two separate scanning systems for each gap direction may be provided, or one scanning gap which is variable in its direction. The size relationships between register mark and scanning gaps emerge from FIG. 7 which is to scale. The line width is approximately 0.1 mm, the size of the entire register mark being approximately 4.5×13 mm.

The register mark in FIG. 7 corresponds, in its basic principle, to that one described in the initially mentioned DE-C-3226078, yet, compared with the latter, has the advantage that it permits a considerably more precise and more reliable measurement (lines instead of edges, and point widening has no influence on measured result) and, in addition, it is considerably smaller and more compact, based on the same number of printing colors.

Figure 8:
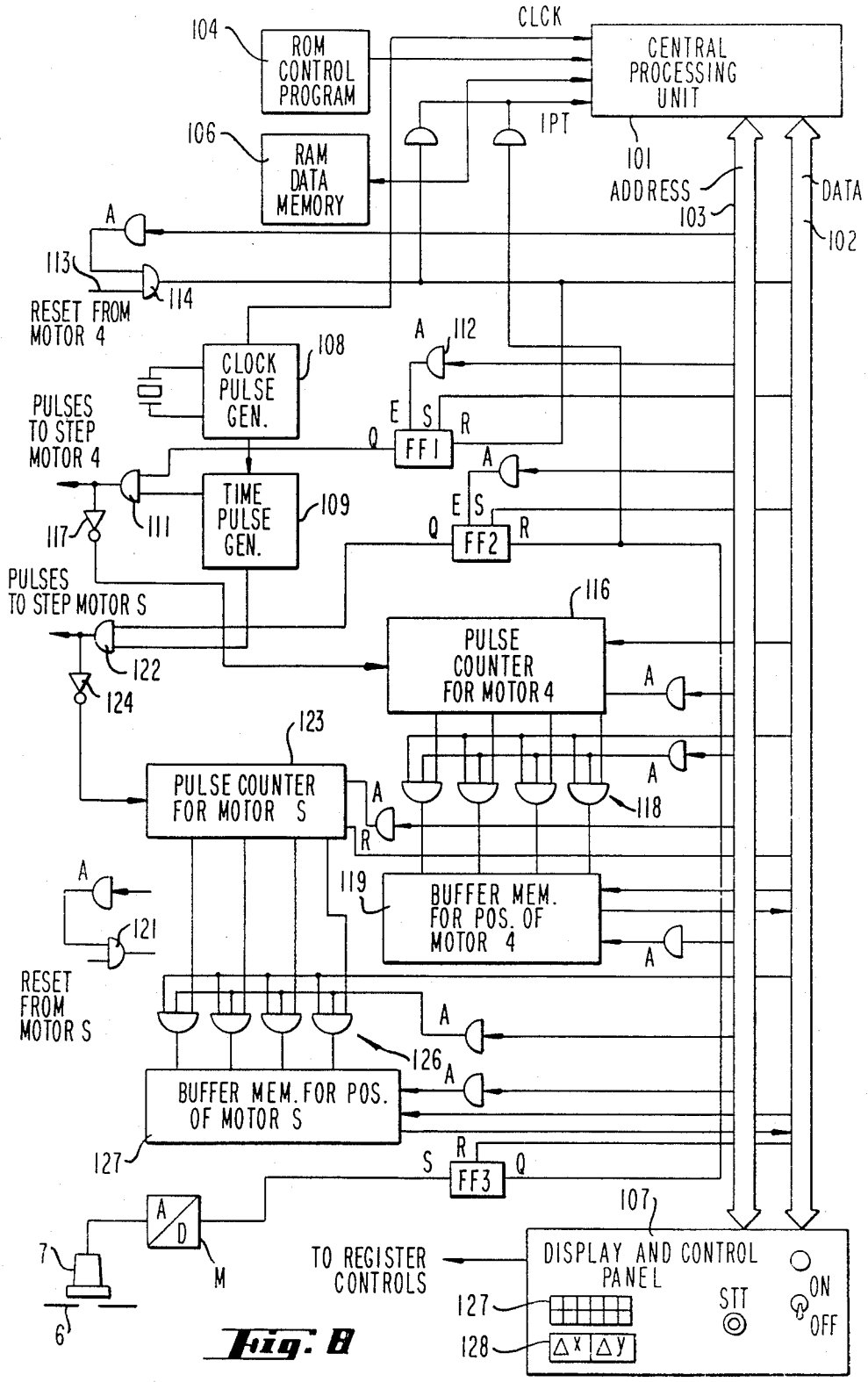
FIG. 8 is a schematic circuit diagram of the control circuit for the invention.

FIG. 8 is a typical circuit diagram of the control circuit for the invention, especially in the embodiment shown in FIG. 1, but other embodiments of the invention can be controlled by a similar circuit which is suitably modified.

In FIG. 8 a conventional central processing unit, CPU 101 having a control program in read-only memory 104, and a random access memory RAM 106 for storing transient data, serves for coordinating the step-by-step operation of the control circuit and the general operation of the invention. A data bus 102 and an address bus 103 connected to the CPU 101 provides the addressing of all the elements of the control circuit via address gates all marked A, and the data bus which, after an element has been addressed, sends or receives commands and responses to each element in a conventional manner.

The operation of the system is shown in greater detail in the flow-chart of FIG. 9 which will be described in more detail hereinbelow.

A crystal-controlled clock generator 108 drives the CPU 101 and a time pulse generator 109, which generates pulses for driving the step motor 4 which in turn controls the position of the filter wheel 5. The filter wheel has a color sector for each printing color, typically the colors of the four color marks 11–14 (FIGS. 2*a* and 2*b*). The motor 4 is stepped by pulses via an AND-gate 111 controlled by a flip-flop FF1, in turn controlled by an enabling address gate 112 connected to the address bus 103 and the data bus 102. When the flip-flop FF1 is set at the start of a measuring operation, flip-flop FF1 is set at pin S with its pin Q going high, enabling AND-gate 11 to drive the motor 4 to its home or reset position, which is indicated by the reset lead 113 from the motor 4 going high, sending a pulse via AND-gate 114 to the CPU, signalling the start of the actual measuring operation.

The start signal from gate 14 sends an interrupt signal to pin IPT of the CPU 101 requesting it to initiate a measuring operation, and resets flip-flop FF1, which stops the motor 4 via pin Q and gate 111. Starting the measuring operation, flip-flop FF1 is first set via pin S from the CPU 101, causing the motor 4 to start stepping to position the filter section of the wheel 5 having the color of the first color mark to be measured, eg. color mark 12. From the reset position of motor 4, a certain given number of steps are required to step the wheel 5 to each of the required color sector positions. The drive pulses are counted in pulse counter 116 driven from the output of gate 111 through inverter 117. The contents of the counter 116 are repeatedly transferred via gates 118, under control of the CPU 101 to a buffer memory 119 for temporarily holding the count of the counter 116, until it can be read by the CPU and transferred into its data memory 106. When the count of stepping pulses has reached the required number of pulses to place the wheel 5 with the proper color sector in the light beam from the measuring optic 3, the motor is stopped by resetting of FF1, by the CPU 101.

In the meantime, the motor S has been stepped to its reset position by pulses from the time pulse generator 109 via AND-gate 122 until a reset signal has been received from the motor S via AND-gate 121, in a manner similar to the resetting of motor 4, which is not shown in all details for the sake of clarity. Next motor S is stepped, by setting flip-flop FF2 by the CPU, via AND-gate 122, while the stepping pulses are being counted in the pulse counter 123 via inverter 124. The motor S is stepped along until the photo electric receiver 7 encounters a change in the light beam intensity. The horizontal line 15, in FIG. 3 indicated by a change in the light beam intensity, is the firt mark to be stored. It is sensed by receiver 7, and converted to a pulse in circuit M, which sets flip-flop FF3, the output Q of which goes high, sends an interrupt signal to the CPU 101, pin IPT and resets flip-flop FF2, stopping motor S via output Q of FF2 which goes low, disabling gate 122. Meanwhile the number of steps driving the motor S have been counted by the pulse counter 123. The count is read by the CPU 101 via gates 126 and the buffer memory 127 and stored as the angle $\alpha_1$ from which the other angles are measured, in the data memory 106 for later processing. Next the motor S is started again by setting flipflop FF2 via pin S, and the motor S resumes the scan. Next again, the lightspot LF encounters the color mark 12 at line 12*a* (FIG. 3). The change in light intensity is again sensed by the light receiver 7, and the number of steps stored in pulse counter 123 is transferred to the data memory 106 via gates 126 and buffer memory 127, as described above, as angle $\alpha_2$. Again the scan is resumed, until angle $\alpha_3$ is determined and next the angle $\alpha_6$.

With each of these angles in the data memory, the computer computes the parameters $\Delta x$ and $\Delta y$ according to equations (1) and (2) above. These parameters provide the register settings required in order to properly align the color of color marker 12, as described above.

It follows that in a complete scan, after the angle $\alpha_4$ has been determined, it is possible to advance the filter wheel 5 to the next color as represented by the color mark 13, and then resume the rotation of motor S and determine the angles corresponding to angles $\alpha_2$ and $\alpha_3$ for each of the color marks 13, 14 and 11 so that all the pertinent angles for all four color markers can be obtained in one scan, and that the parameters $\Delta x$ and $\Delta y$ can be computed for all four color marks.

A display and control panel 107 may be used as the I/O unit D. As shown in FIG. 8, the display and control panel may advantageously have control keys 127 for starting, stopping, testing and controlling the device and for reading the parameters $\Delta x$ and $\Delta y$.

Figure 9:
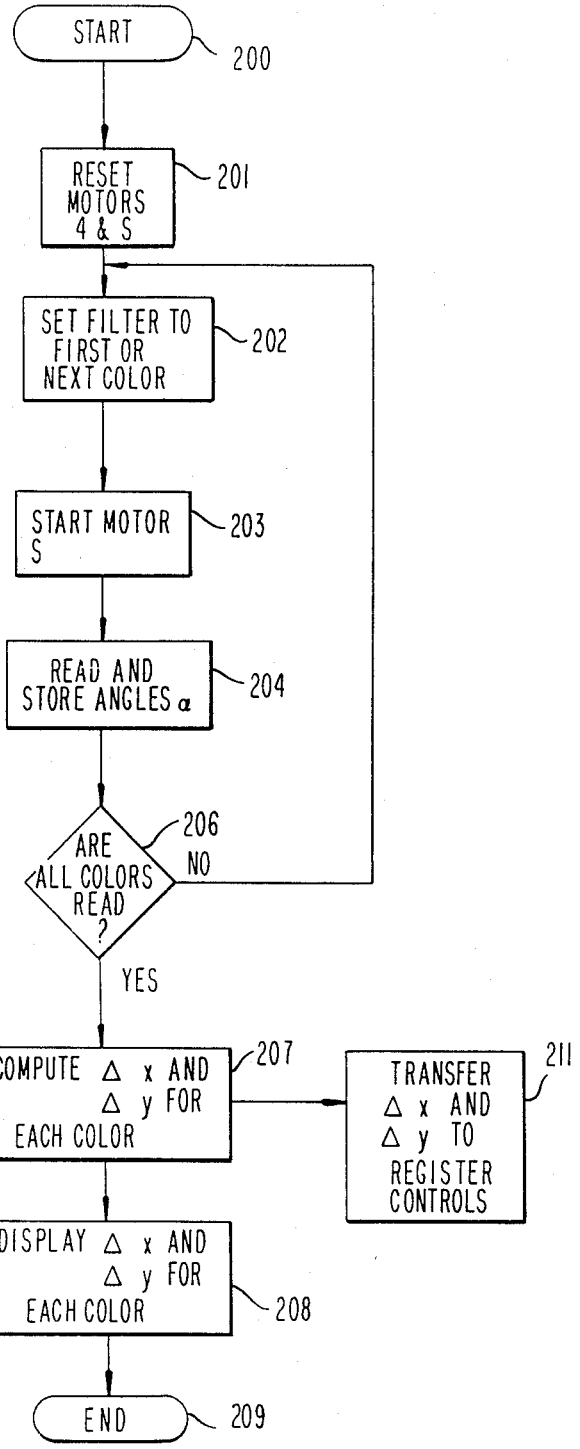
FIG. 9 is a flow-chart showing step-by-step the operation of the invention.

FIG. 9 is a flow-chart showing the steps of a complete scanning operation. After start 200, the motors 4 and S are reset in step 201, and the filter wheel is set in step 202 with its color sector of the first or next color mark to be measured, in the light beam. Next the mtor S is started to commence the scan (step 203) of the first or next color mark to determine the angles $\alpha_1$, $\alpha_2$, $\alpha_3$ and $\alpha_4$ for that color mark, and the angles are stored, e.g. as the number of steps counted as the motor turns, in step 204. Decision step 206 repeats the process by going back to step 202 until all color marks have been measured, at which time, in the next step 207 the parameters $\Delta x$ and $\Delta y$ are computed according to equations (1) and (2). In step 208 the parameters are displayed and the scan is computed. A further step 211 may be provided for transferring the parameters $\Delta x$ and $\Delta y$ to the printing machine's registers, under control of commands entered, e.g. at the display and control panel 107.

The flow-chart FIG. 9 serves as the base for the construction of the control program stored in the control program memory 104, using well known, conventional programming methods.

It follows that suitable modifications may readily be made by persons skilled in the art to which the invention pertains, in the control circuit and the flow-chart to accommodate after scanning modes, as shown for example in FIGS. 4, 5, 6 and 7.

It also follows that the motor S and 4 may be controlled by other well known means widely used in control of servo motors, such as binary coded commutators or the like attached to the motor shafts.

The foregoing is a description corresponding in substance to Switzerland Application 01 567/86-5, dated Apr. 18, 1986, and Switzerland Application 02 392/86-1 dated June 13, 1986, the International priority of which is being claimed for the instant application, and which is hereby made part of this application. Any material discrepancies between the foregoing specification and the aforementioned corresponding Switzerland application are to be resolved in favor of the latter.

We claim:

1. Device for determining a register error between individual colors in a multicolor printing machine, comprising a photoelectric scanning apparatus for scanning differently colored register marks printed together on a printed sheet, an evaluation apparatus interacting with the scanning apparatus for determining the relative positions of the individual register marks, the scanning apparatus being disposed in a single housing to be positioned at a given measuring location on the stationary printed sheet, the scanning apparatus comprising a scanning head movably disposed in the housing, and a single motor drive provided in the housing and having a drive shaft eccentric to said scanning head for rotating said scanning head so as to produce the scanning movement of the scanning head relative to the printed sheet within a relatively small scanning region.

2. Device according to claim 1, wherein the scanning head is rotatably movable in the housing.

3. Device according to claim 1, wherein the scanning apparatus and the evaluation apparatus operate to detect at least one of line-shaped and line-containing register marks, and to determine their relative positions.

4. Device according to claim 3, having at least one aperture diaphragm included in the scanning head, said aperture diaphragm having a linear slit disposed in such relationship to the housing that, when in use, the slit is oriented parallel with the line-shaped register marks to be scanned.

5. Device according to claim 4, wherein said scanning head has two slit-shaped aperture diaphragms the slits being disposed at an angle selected from angles of 45 and 90 degrees to one another.

6. Device according to claim 1, wherein said scanning head has means for scanning, point-by-point, a two-dimensional scanning region.

7. Device according to claim 1, wherein the scanning head contains a line array and is swivelable into two fixed positions for measuring the register mark, one after the other, in the housing.

8. Device according to claim 1, wherein the scanning head contains at least one of a line array and an area array, and is linearly movable in one direction inside the housing.

9. Device according to claim 1, wherein the housing is equipped with an optical or optoelectronic apparatus for assistance during visual aligning of the scanning apparatus on the register mark.

10. Device according to claim 1, wherein both said scanning apparatus and said evaluation apparatus are located in said housing.

11. Register mark for determining a register error in multicolor printing machines, comprising at least one angle for each color to be printed, each angle being formed of two rectilinear line-shaped sides and being individual differently colored, each angle being disposed, substantially uniformly spaced, in a circle so that their tips point to the center of the circle.

12. Register mark according to claim 11, including a basically cruciform element disposed in the center of the circle, each element having a color conforming with at least one of the colored angles or having a color which is a superposition of all of the printed colors.

13. Register mark for determining a register error in multicolor printing machines, wherein, for each printed color being printed involved, the register mark comprises at least one element having a first and a second rectilinear line-shaped side, the individual differently colored elements being disposed parallel, at intervals along a straight line, and the sides of each element being inclined to one another.

14. Register mark according to claim 13, wherein the two sides of the elements are spaced separately from one another, and firstly all first sides and then all second sides of the differently colored elements are spaced in succession along the straight line.

* * * * *